US009010765B2

(12) United States Patent
Miyashita et al.

(10) Patent No.: US 9,010,765 B2
(45) Date of Patent: Apr. 21, 2015

(54) GASKET AND AUTOMOTIVE COMPONENT

(75) Inventors: Naomichi Miyashita, Aichi (JP); Mamoru Musasa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 821 days.

(21) Appl. No.: 12/237,513

(22) Filed: Sep. 25, 2008

(65) Prior Publication Data

US 2009/0085304 A1 Apr. 2, 2009

(30) Foreign Application Priority Data

Sep. 28, 2007 (JP) ..... 2007-252995

(51) Int. Cl.
*H01T 13/08* (2006.01)

(52) U.S. Cl.
CPC ..... *H01T 13/08* (2013.01)

(58) Field of Classification Search
CPC . F16J 15/0887; F16J 15/0893; F16J 15/0825; F16J 2015/0837; H01T 13/08
USPC ..... 277/591
See application file for complete search history.

(56) References Cited

U.S. PATENT DOCUMENTS

| | | | | | |
|---|---|---|---|---|---|
| 1,609,283 | A * | 12/1926 | Bailey | ..... | 277/644 |
| 2,569,778 | A * | 10/1951 | Phillips | ..... | 277/434 |
| 3,879,043 | A * | 4/1975 | Tozer | ..... | 277/647 |
| 6,489,709 | B1 * | 12/2002 | Teramura et al. | ..... | 313/140 |
| 6,612,030 | B2 * | 9/2003 | Halling | ..... | 29/888.3 |
| 2004/0066124 | A1 | 4/2004 | Kanao et al. | ..... | 313/135 |

FOREIGN PATENT DOCUMENTS

| | | | | |
|---|---|---|---|---|
| JP | 59-39894 | 3/1984 | ..... | H01T 13/08 |
| JP | 11351393 | 12/1999 | ..... | F02F 11/00 |
| JP | 2004-134120 | 4/2004 | ..... | H01T 13/08 |

OTHER PUBLICATIONS

Office Action mailed on Nov. 16, 2010 issued by the Japanese Patent Office from a corresponding Japanese Patent Application No. 2008-178566, together with its English translation. 7 pages.

* cited by examiner

*Primary Examiner* — Shane Bomar
*Assistant Examiner* — Kipp Wallace
(74) *Attorney, Agent, or Firm* — Kusner & Jaffe

(57) ABSTRACT

A gasket for use around a thread neck of an automotive component, the gasket dimensioned to prevent the gasket from falling off of the thread neck and to prevent a male screw portion from biting into the gasket.

4 Claims, 8 Drawing Sheets

GASKET AND AUTOMOTIVE COMPONENT

FIELD OF THE INVENTION

The present invention relates to a gasket provided around a thread neck of an automotive component, such as a spark plug for combustion engines and a sensor, and to an automotive component where the gasket is installed.

BACKGROUND OF THE INVENTION

A conventional spark plug used for igniting a combustion engine, such as a gasoline engine for automobiles is comprised of a center electrode, an insulator accommodating the center electrode therein, a cylindrical metal shell accommodating the insulator therein and a ground electrode in which a base end thereof is joined to a front end portion of the metal shell. A male screw portion is formed around an outer circumference face of the metal shell. An outwardly projecting, annular gasket receiving portion is formed on a rear end side of the male screw portion.

A screw hole having a female screw portion is formed in an engine cylinder head. The spark plug is mounted on the engine by screwing the male screw portion into the female screw hole in the engine cylinder head. A portion called a thread neck is provided between a rear end side of the male screw portion of the metal shell and the gasket receiving portion. An annular gasket is provided around the thread neck. With screwing the male screw portion into the screw hole, the gasket is compressed and crushed between the gasket receiving portion and an opening circumference edge portion of the female screw hole to thereby provide a seal between the screw hole and the gasket receive portion.

As a common gasket, it has been known that a gasket formed such that a ring-shaped thin metal plate is radially bent with a special die into, for example, a generally "S" shape in a cross-sectional view, which is so to speak a hollow shape. Such a gasket is subjected to a predetermined nail forming process after being fitted around the thread neck to thereby form a plurality of nail portions (e.g., three nails) projecting in an inner circumference direction. Thus, in the conventional gasket, the nail portion is formed after the gasket is fitted around the thread neck so as to prevent the gasket from falling out from the thread neck (See, for example, Japanese Laid-Open Utility Model Application No. Sho 59-39894).

In recent years, automation has been advanced in various industrial fields. Spark plugs are also automatically mounted on engines using a robot. More particularly, a large number of spark plugs where gaskets are provided are tidily allocated in support holes of a pallet, and a robot picks up a spark plug from the pallet and conveys it to an engine. Then, the robot tightly screws a male screw portion of the spark plug into a screw hole of an engine cylinder head. In addition, when the spark plug is automatically mounted on the engine cylinder head, the spark plug is supported in a state where the gasket is in contact with a circumference of the support hole of the pallet and extends in a vertical direction.

However, the conventional spark plug tends to have a problem that a nail portion of the gasket is likely to enter into between adjacent thread ridges of the male screw portion, and also the male screw portion bites into the nail portion. When this problem occurs, the gasket inclines with respect to an axial center of the spark plug when mounted. Therefore, in this case, the spark plug having the inclined gasket with respect to the circumference of the support hole of the pallet is supported at the time of the automatic mounting operation.

That is, the spark plug is supported in an inclined state. Therefore, there is a possibility that the robot may incorrectly operate a removal control or may judge that a supporting position of the spark plug is not in a scheduled location. As a result, the mounting operation of the spark plug on the engine may be hampered.

In addition, the problem that the male screw portion bites into the gasket as mentioned above does not only occur to the spark plug where the gasket is provided, but also occurs to automotive components, such as sensors, where various kinds of gaskets are provided.

The present invention has been accomplished in light of the above-mentioned problems, and an object of the present invention is to provide a gasket provided around a thread neck of an automotive component. The invention prevents the gasket from falling out, as well as effectively preventing a male screw portion from biting into the gasket.

SUMMARY OF THE INVENTION

In accordance with one aspect (Aspect 1) of the present invention, there is provided a gasket for an automotive component, comprising, from a front end to a rear end in an axial direction:

a male screw portion;

a thread neck having a smaller outer diameter than that of a thread ridge of the male screw portion; and a gasket receiving portion having a flat face facing the front end direction and located at a rear end side of the thread neck.

The annular gasket is provided around the thread neck which is formed between the male screw portion and the gasket receiving portion, and has an axial center which serves as a center of the gasket, and is formed such that a plurality of plate-like portions is stacked in the axial direction.

The gasket comprises an inner tube portion extending in an axial direction and constituting an inner circumference face of the gasket, and in which a minimum inner diameter of the inner tube portion is larger than an outer diameter of the thread neck and smaller than the thread ridge of the male screw portion; an upper large diameter portion and a lower large diameter portion extending from an upper end and a lower end of the inner tube portion in the axial direction so that an inner diameter of the gasket gradually increases; an upper plate-like portion and a lower plate-like portion extending from the upper large diameter portion and the lower large diameter portion, respectively, towards a radial direction perpendicular to the axial direction, and constituting a piece of the plate-like portions and at least one or more intervening plate-like portion(s) intervening between the upper plate-like portion and the lower plate-like portion, and constituting a piece of the plate-like portions, wherein the gasket assumes an identical cross-sectional shape in an entire circumference thereof.

Although the inner tube portion in aspect 1 is described as "extending in the axial direction", it is not necessarily limited to strictly a "linear shape parallel to the axial direction in the cross-section", as long as the inner tube portion "constitutes the inner circumference face of the gasket". Thus, the inner tube portion may assume a circular arc shape in the cross-section, which slightly bulges into the inner circumference side.

Further, the upper large diameter portion or the lower large diameter portion in aspect 1 may have a radius of curvature varying according to each region thereof, as long as the inner diameter of the gasket gradually increases from the upper end and lower end of the inner tube portion in the axial direction. However, it is excluded that the gasket assuming a meander shape in the cross-section where the center of the radius of curvature switches from the inside to the outside of the gasket. The upper large diameter portion and the lower large diameter portion may assume a generally linear shape in the cross-section.

Furthermore, the upper plate-like portion and the lower plate-like portion and the intervening plate-like portion, all of which constitute the plate-like portion, assume a generally plate-like shape. However, it is not necessarily limited to strictly a plate-like (planar) shape. That is, as long as the upper plate-like portion and the lower plate-like portion or the intervening plate-like portion are recognized as "a shape extends in a radial direction perpendicular to the axial direction", a curved shape like drawing a gradual arc is acceptable.

Moreover, the "intervening plate-like portion", which intervenes between the upper plate-like portion and the lower plate-like portion, constitutes a piece of the "plate-like portions". A configuration of the "intervening plate-like portion" may be a single piece or plural pieces.

In aspect 1, "the upper plate-like portion may be positioned at the uppermost surface among all portions of the gasket and the lower plate-like portion 55 may be positioned at the lowermost surface among all portions of the gasket". When the configuration of the gasket is limited in this way, a portion bent further upwards over the upper plate-like portion and a portion bent further downwards over the lower plate-like portion are excluded.

According to aspect 1, when the male screw portion is screwed into a fitting portion, such as an engine screw hole, the gasket is compressed and crushed between the gasket receiving portion and the opening circumference edge portion of the screw hole so as to provide a seal between the screw hole and the gasket receiving portion. At this time, the upper plate-like portion, the lower plate-like portion and the intervening plate-like portion, all of which constitute the plate-like portions, are stacked, and the gasket is deformed to thereby reduce the distance between the plate-like portions.

In aspect 1, the minimum inner diameter of the inner tube portion is larger than the outer diameter of the thread neck and smaller than the outer diameter of the thread ridge of the male screw portion. Thus, it is possible to prevent the gasket from falling out from the thread neck. Since the gasket before being provided around the thread neck is necessarily fitted around the thread neck, the minimum inner diameter of the inner tube portion needs to be larger than the outer diameter of the thread ridge of the male screw portion. As will be described later, the gasket before being provided around the thread neck (hereafter referred to as a "gasket before processing") is preferably formed so that a portion serving as the inner tube portion assumes a generally linear shape, and has a predetermined height. The gasket according to aspect 1 is formed by compressing the gasket before processing in the height direction after being installed.

The gasket includes the inner tube portion extending in the axial center direction, and the inner tube portion constitutes the inner circumference face of the gasket. Thus, unlike a conventional art where a nail portion points in an inward direction tends to enter into between the thread ridges of the male screw portion, the male screw portion is unlikely to bite into the inner tube portion. As a result, when the gasket is provided around the thread neck, it is possible to prevent the gasket from falling out from the thread neck, as well as effectively preventing the male screw portion from biting into the gasket.

In accordance with another aspect (Aspect 2) of the present invention, there is provided in addition to aspect 1, a gasket wherein in the cross-sectional view passing through the axial center of the gasket, two tangent lines contacting the upper large diameter portion and the lower large diameter portion, respectively, are drawn so that an intersection angle defined by the tangent lines is 60 degrees, wherein the axial center of the gasket and the tangent lines, and the axis line of an automotive component and an outer line of the male screw portion are projected on the same virtual plane to thereby align the axial center and the axis line, wherein the intersection of the tangent lines is located on an inner circumference side with respect to a thread core of the male screw portion.

Aspect 2 further limits the shape of the inner tube portion or the upper large diameter portion and the lower large diameter portion of the gasket according to aspect 1. That is, in the cross-sectional view passing through the axial center of the gasket, two tangent lines contacting the upper large diameter portion and the lower large diameter portion, respectively, are drawn so that the intersection angle defined by the tangent lines is 60 degrees. Further, the axial center of the gasket and the tangent lines, and the axis line of the automotive component and the outer line of the male screw portion are projected on the same virtual plane to thereby align the axis center and the axis line. Here, " . . . projected . . . to thereby align . . . " means a state that the tangent lines of the gasket and the male screw portion are overlapped on the virtual plane. That is, since it is impossible to visually recognize that the virtual tangent lines to slide, it is specified as a "projection". When the above projection is conducted, the intersection of two tangent lines is located on the inner circumference side with respect to the thread core of the male screw portion. In this way, the inner tube portion does not enter into between the thread ridges whereby it is possible to reliably prevent a failure caused by the male screw portion biting into the gasket.

In accordance with another aspect (Aspect 3) of the present invention, there is provided in addition to aspects 1 or 2, a gasket wherein all the plate-like portions are integrally formed in a continuous manner.

Basically, all the configurations mentioned above are necessarily provided. The intervening plate-like portion may not be necessarily integrally formed with the upper plate-like portion or the lower plate-like portion in a continuous manner, as long as it intervenes between the upper plate-like portion and the lower plate-like portion. The gasket may be formed by a plurality of separate parts. On the other hand, in aspect 3, all the plate-like portions are integrally formed in the continuous manner. That is, the intervening plate-like portion is integrally formed with the upper plate-like portion or the lower plate-like portion in the continuous manner. Therefore, any defect caused by a gasket that is formed by a plurality of separate parts, such as complication at the time of manufacturing of a gasket (e.g., assembly of plural parts) or a sealing failure due to a positional misalignment of each part at the time of clamping, can be prevented.

In accordance with yet another aspect (Aspect 4) of the present invention, there is provided in addition to any one of aspects from 1 to 3, the gasket wherein the intervening plate-like portion is comprised of an upper intervening plate-like portion and a lower intervening plate-like portion, wherein the upper intervening plate-like portion is integrally formed with the upper plate-like portion in a continuous manner through an upper bending portion, and wherein the lower intervening plate-like portion is integrally formed with the lower plate-like portion in a continuous manner through a lower bending portion.

According to aspect 4, the upper plate-like portion, the lower plate-like portion, the upper intervening plate-like portion and the lower intervening plate-like portion, all of which constitute plate-like portions, are stacked, and the gasket is deformed to thereby reduce the distance between the plate-like portions.

In accordance with still another aspect (Aspect 5) of the present invention, there is provided in addition to any one of aspects 1 to 4, a gasket wherein the inner tube portion assumes either a linear shape in the cross-section parallel to the axial direction or a circular arc shape in the cross-section with a radius of curvature R of 0.44 P or more (Preferred to as a thread pitch) bulging towards an inner circumference side (unit of R and P is millimeter).

According to aspect 5, the inner tube portion assumes either the linear shape in the cross-section parallel to the axial direction or the circular arc shape in the cross-section with the radius of curvature R of 0.44 P or more bulging towards the inner circumference side. Therefore, the inner tube portion does not enter into between the thread ridges whereby it is possible to reliably prevent a failure caused by the male screw portion biting into the gasket.

The reason for selecting a "radius of curvature R of 0.44 P or more" will be explained. As a male screw portion used for a spark plug or the like, a typical thread diameter is M14, M12 or M10. According to JIS B8031, as for M14, a thread pitch is 1.25 mm and a thread outer diameter is 13.725 mm. As for M12, a thread pitch is 1.25 mm and a thread outer diameter is 11.725 mm. As for M10, a thread pitch is 1.00 mm and a thread outer diameter is 9.794 mm (the above-mentioned values are the minimum values specified in JIS specification). Furthermore, when considering an angle of the thread core, which is set to be 60 degrees, the minimum inner diameter of the gasket can be also calculated using the above-mentioned value. After calculating the minimum inner diameter of the gasket, the minimum radius of curvature (R1) where the inner tube portion does not enter into between thread ridges can be calculated. For M14: R1=0.545 mm; M12: R1=0.545 mm; M10: R1=0.444 mm. Then, when each minimum radius of curvature (R1) is divided by the respective thread pitch, M14 and M12 are 0.436, and M10 is 0.444. As a result, even though the inner tube portion assumes the circular arc shape in the cross-section bulging towards the inner circumference side, it does not practically enter into between the thread ridges as long as the radius of curvature R is 0.44 P or more.

In accordance with still another aspect (Aspect 6) of the present invention, there is provided the technical concept of each invention can also be embodied in an automotive component comprising a gasket according to any one of aspects 1 to 5.

In addition, as a typical automotive component, it is possible to cite a spark plug, a sensor or the like.

DETAILED DESCRIPTION OF PREFERRED EMBODIMENT

Figure 1:
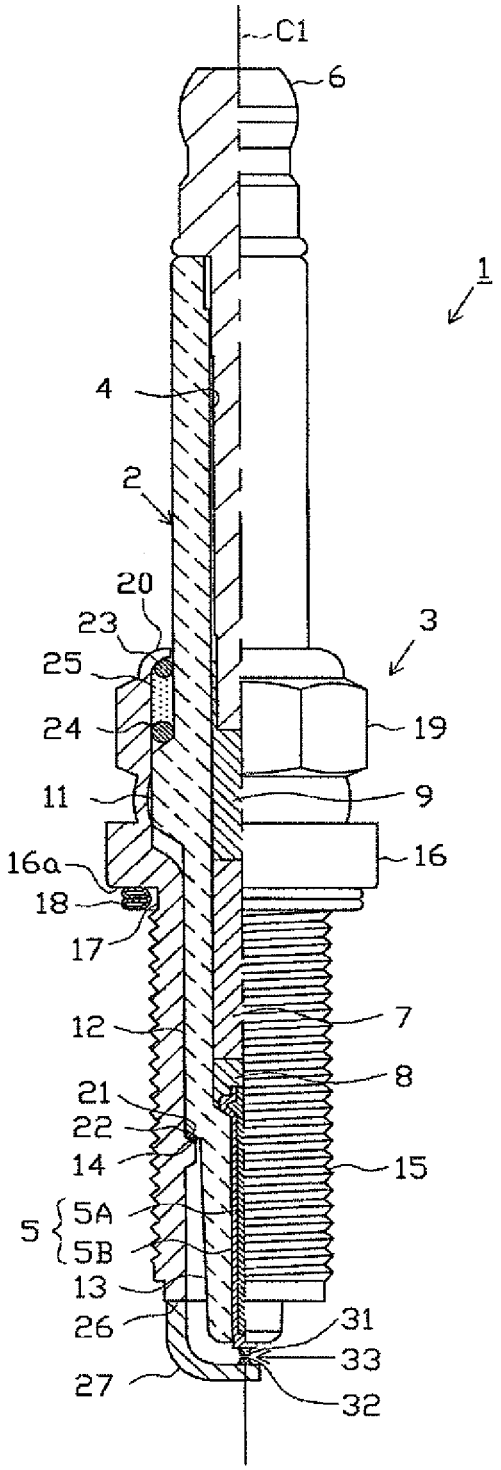
FIG. 1 is a partial cross-sectional view showing a configuration of a spark plug according to an embodiment.

Hereafter, an embodiment of the present invention will be described with reference to the drawings. FIG. 1 is a partial cross-sectional view showing a configuration of a spark plug 1. A direction of an axis line C1 of the spark plug 1 is regarded as a top to bottom direction in FIG. 1. A lower side of the drawing is regarded as a front end side of the spark plug 1 and an upper side of the drawing is regarded as a rear end side of the spark plug 1.

A spark plug 1 is comprised of a cylindrical insulator serving as an insulating material, a cylindrical metal shell 3 accommodating the insulator 2 therein, and the like.

The insulator 2 has an axial bore 4 therein which extends along the axis line C1. A center electrode 5 is inserted and fixed to a front end side of the axial bore 4. A terminal electrode 6 is inserted and fixed to a rear end side of the axial bore 4. A resistor 7 is disposed between the center electrode 5 and the terminal electrode 6 in the axial bore 4. Both ends of the resistor 7 are electrically connected to the center electrode 5 and the terminal electrode 6, respectively, through the conductive glass seal layers 8 and 9.

The center electrode 5 is fixed so as to project from a front end of the insulator 2, and the terminal electrode 6 is fixed so as to project from a rear end of the insulator 2. Further, a noble metal tip 31 is joined to a front end of the center electrode 5 by welding (this will be described later).

The insulator 2 is formed by firing alumina or the like as is commonly known. The insulator 2 is comprised of a flange-shaped large diameter portion 11 radially projecting towards the outside. A flange-shaped, large diameter portion is formed generally at a central area in the axis line C1. An intermediate body portion 12 formed at the front end side with respect to the large diameter portion 11. Intermediate body portion 12 has a smaller diameter than that of the large diameter portion 11. An elongated leg portion 13 formed at the front end side with respect to the intermediate body portion 12. Elongated leg portion 13 has a smaller diameter than that of the intermediate body portion 12 and is exposed to a combustion chamber of an internal combustion engine. The front end side of the insulator 2, which includes the large diameter portion 11, the intermediate body portion 12 and the elongated leg portion 13, is accommodated in the cylindrical metal shell 3. A step portion 14 is formed between the elongated leg portion 13 and the intermediate body portion 12 so that the insulator 2 is locked by the metal shell 3 at the step portion 14.

The metal shell 3 is made of a metal, such as, by way of example and not limitation, low-carbon steel, and assumes a cylindrical form. A male screw portion 15 is formed on an outer circumference face of the metal shell 3 to facilitate mounting the spark plug 1 on an engine cylinder head 41 (referring to FIG. 2). A flange portion 16 projecting towards the outer circumference is formed on the rear end side with respect to the male screw portion 15. A flat surface of the flange portion 16 located on the front end side serves as a gasket receiving portion 16*a*. A thread neck 17 on which no thread ridges are formed has a smaller outer diameter than that of the male screw portion 15 and is formed between the rear end of the male screw portion 15 and the gasket receiving portion 16*a*. A ring-shaped gasket 18, that shall be described in greater detail below, is provided around the thread neck 17. A tool engagement portion 19, having a hexagonal shape when viewed in cross-section, is provided on the rear end side with respect to the metal shell 3 for engaging with a tool, such as a wrench, when mounting the metal shell 3 on the cylinder head 41. Also, a caulking portion 20 for holding the insulator 2 is provided in the rear end portion of the metal shell 3.

A step portion 21 is formed in an inner circumference face of the metal shell 3 for locking the insulator 2. The insulator 2 is inserted towards the front end side from the rear end side of the metal shell 3 so that the step portion 14 is locked by the step portion 21 of the metal shell 3. Then, an opening portion of the metal shell 3 at the rear end side is radially crimped in an inward direction, i.e., forming the caulking portion 20 to thereby fix the insulator 2 in the metal shell 3. It is noted that an annular plate packing 22 is provided between the step portion 14 of the insulator 2 and the step portion 21 of the metal shell 3. Thus, air tightness in a combustion chamber is kept, and a fuel air introduced to a gap between the elongated leg portion 13 of the insulator 2, which is exposed to the combustion chamber, and the inner circumference face of the metal shell 3 is prevented from leaking out.

Furthermore, in order to achieve a perfect sealing by caulking, on the rear end side of the metal shell 3, annular ring members 23 and 24 are provided between the metal shell 3 and the insulator 2, and talc powder 25 is filled between the ring members 23 and 24. That is, the metal shell 3 holds the insulator 2 through the plate packing 22, the ring members 23, 24 and the talc 25.

Moreover, a generally L-shaped ground electrode 27 is joined to a front end face 26 of the metal shell 3. A base end of the ground electrode 27 is welded to the front end face 26 of the metal shell 3, and a free end of the ground electrode 27 is bent so that a side face of the ground electrode 27 faces the front end portion (the noble metal tip 31) of the center electrode 5. A noble metal tip 32 is provided on ground electrode 27 so as to face the noble metal tip 31 to thereby form a spark-discharge gap 33 therebetween.

The center electrode 5 is comprised of an inner layer 5A made of copper or a copper alloy and an outer layer 5B made of a nickel alloy. Further, the ground electrode 27 is made of nickel alloy or the like.

The rod-like (columnar shape) center electrode 5 is tapered at front end side, and a front end face thereof is formed to be flat. The above-mentioned columnar noble metal tip 31 is joined to the front end face of the center electrode 5 by laser welding, electron beam welding or resistance welding along a joint face outer edge portion. The noble metal tip 32 facing the noble metal tip 31 is disposed on a predetermined location of the ground electrode 27, and the joint face outer edge portion is welded to thereby join the noble metal tip 32 to the ground electrode 27. It is noted that either the noble metal tip 31 or the noble metal tip 32 facing the noble metal tip 31 may be omitted. In this case, the spark-discharge gap 33 is formed between the noble metal tip 31 and a main body of the ground electrode 27, or between the noble metal tip 32 and a main body of the center electrode 5.

Figure 2:
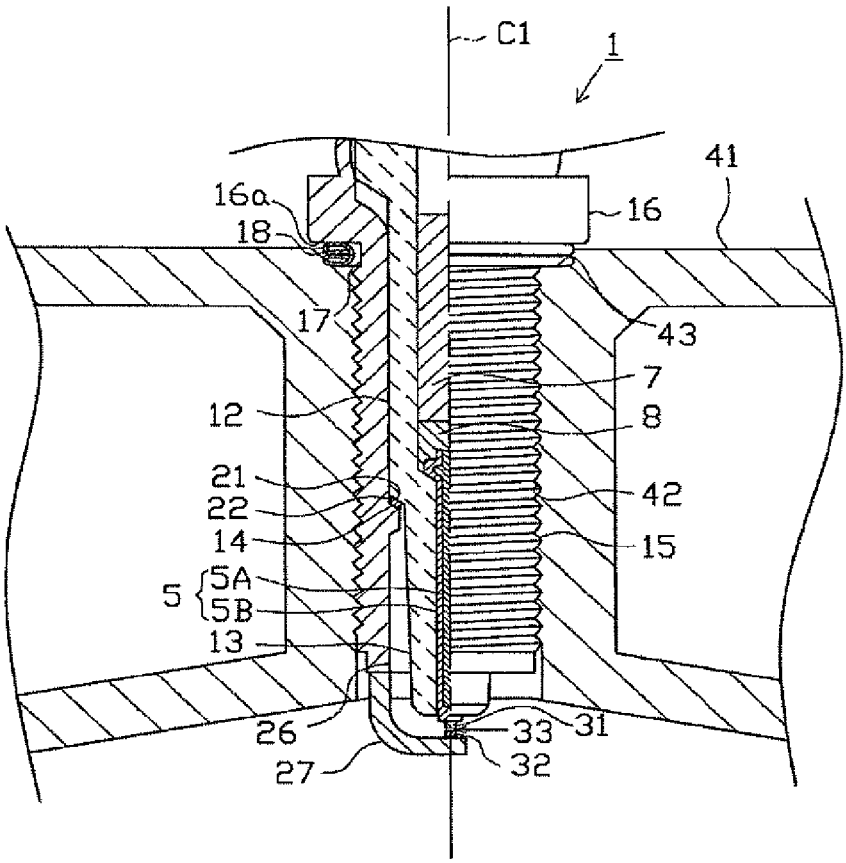
FIG. 2 is a partial cross-sectional view showing a spark plug when mounted.

Hereafter, the gasket 18 that is a characteristic feature of this embodiment will be described in detail. As shown in FIG. 2, the spark plug 1 is mounted on the cylinder head 41 of an engine by screwing the male screw portion 15 into a screw hole 42 of the cylinder head 41. The gasket 18 is compressed and crushed between the gasket receiving portion 16*a* and an opening circumference edge portion 43 of the screw hole 42 to thereby provide a seal between the screw hole 42 and the gasket receiving portion 16*a*. Gasket 18, when compressed and crushed after being mounted, is shown with a two-dot chain line in FIG. 6 (refer to EB in FIG. 6).

Figure 3A:
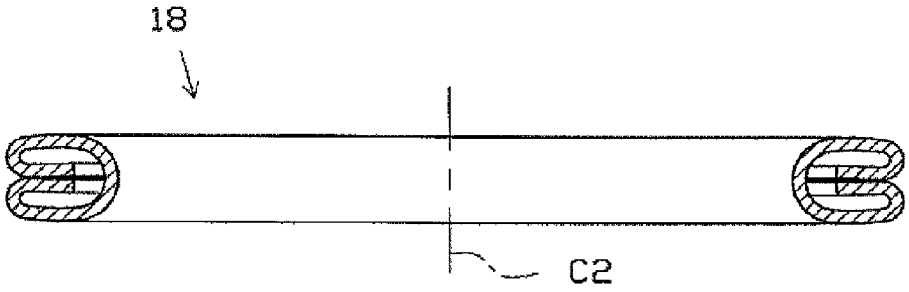
FIG. 3A is a sectional view showing a gasket.
Figure 3B:
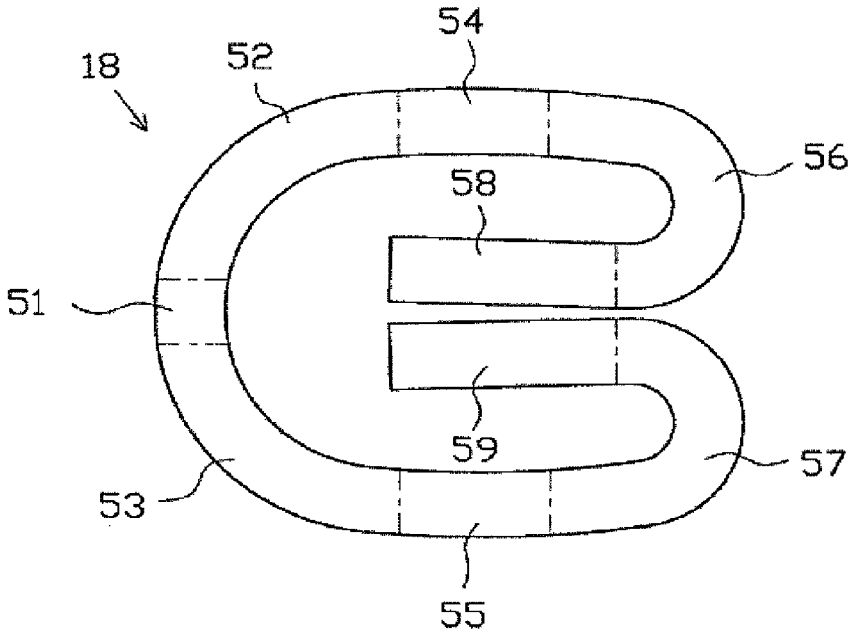
FIG. 3B is a schematic view showing a sectional end face of a gasket for describing each part thereof.

Before screwing the spark plug 1 into the screw hole 42 of the cylinder head 41, as shown in FIG. 3A, the gasket 18 provided around the thread neck 17 assumes an annular shape and has an axial center C2 which serves as a center of the gasket 18. As shown in FIG. 3B, the gasket 18 is comprised of an inner tube portion 51, an upper large diameter portion 52, a lower large diameter portion 53, an upper plate-like portion 54, a lower plate-like portion 55, an upper bending portion 56, a lower bending portion 57, an upper intervening plate-like portion 58 and a lower intervening plate-like portion 59.

More particularly, the inner tube portion 51 constitutes an inner circumference face of the gasket 18 and extends in an axial direction (a direction where the axial center C2 extends). The upper large diameter portion 52 extends from the upper end in the axial direction of the inner tube portion 51 so that an inner diameter of the gasket gradually increases. The lower large diameter portion 53 extends from the lower end in the axial direction of the inner tube portion 51 so that an inner diameter of the gasket gradually increases. Further, the upper plate-like portion 54 extends radially (i.e., perpendicular to the axial direction) from the upper large diameter portion 52, and the lower plate-like portion 55 extends radially (i.e., perpendicular to the axial direction) from the lower large diameter portion 53.

Furthermore, the upper intervening plate-like portion 58 is integrally formed with the upper plate-like portion 54 through the upper bending portion 56 in a continuous manner and assumes a generally "U"-shape in the cross-section. The lower intervening plate-like portion 59 is integrally formed with the lower plate-like portion 55 through the lower bending portion 57 in a continuous manner and assumes a generally "U"-shape in the cross-section. The upper intervening plate-like portion 58 and the lower intervening plate-like portion 59 are disposed between the upper plate-like portion 54 and the lower plate-like portion 55. Each plate-like portion 54, 55, 58, 59 is connected to each other (for convenience sake, each portion 51-59 is depicted with dotted-lines in FIG. 3B).

In a state where before a spark plug 1 is mounted on the engine cylinder head 41, i.e., the spark plug 1 serves as an "automotive component" before being mounted. The minimum inner diameter of the inner tube portion 51 is larger than the outer diameter of the thread neck 17, and smaller than the outer diameter of the thread ridge of the male screw portion 15. Thereby, the gasket 18 is prevented from falling out from the thread neck 17.

The inner tube portion 51 is not limited to a "linear shape in the cross-section parallel to the axial direction," but may assume a circular arc shape in the cross-section bulging towards the inner circumference side to some extent, as shown in the drawing, as long as it constitutes the inner circumference face of the gasket 18.

Further, the upper large diameter portion 52 and the lower large diameter portion 53 in this embodiment may have a radius of curvature varying according to each region thereof, as long as the inner diameter of the gasket gradually increases from the upper and lower ends of the inner tube portion 51 in the axial direction. However, it is excluded that the gasket assumes a winding or circuitous shape in the cross-section where the center of radius of curvature switches from inside to outside of the gasket.

Further, the upper plate-like portion 54 and the lower plate-like portion 55, or the upper intervening plate-like portion 58 and the lower intervening plate-like portion 59, all of which constitutes a plate-like portion, assume a generally plate-like shape. However, it is not necessarily limited to strictly a plate-like (planar) shape. That is, as long as it can be recognized as "a shape extends in a radial direction perpendicular to the axial direction," some camber or a curved shape, such as a loose arc, is allowable.

In this embodiment, the upper plate-like portion 54 is positioned at the uppermost surface among all portions of the gasket 18 and the lower plate-like portion 55 is positioned at the lowermost surface among all portions of the gasket 18. Therefore, a portion bent further upwards over the upper plate-like portion 54 and a portion bent further downwards over the lower plate-like portion 55 are excluded in this embodiment.

Figure 4:
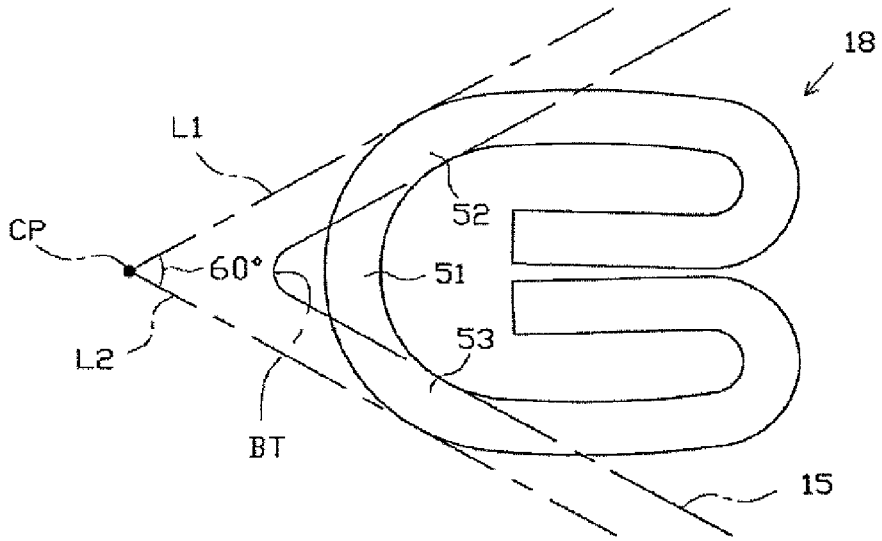
FIG. 4 is a schematic view showing a sectional end face of a gasket for describing a configuration of an inner tube portion.

Referring to FIG. 4, a cross-sectional view of the inner tube portion 51 passing through the axial center C2 is shown. Two tangent lines L1 and L2, contacting the upper large diameter portion 52 and the lower large diameter portion 53, respectively, are drawn so that an intersection angle defined by the tangent lines L1, L2 is 60 degrees. The axial center C2 of the gasket 18 and the tangent lines L1, L2 and the axis line C1 of the spark plug 1 and the outer line of the male screw portion 15 (thread ridge, thread core) are projected on the same virtual plane to thereby align the axial center C2 and the axis line C1. On this projection view, an intersection CP of the tangent lines L1, L2 is located on an inner circumference side (left-hand side in FIG. 4) with respect to a thread core BT of the male screw portion 15.

Figure 5:
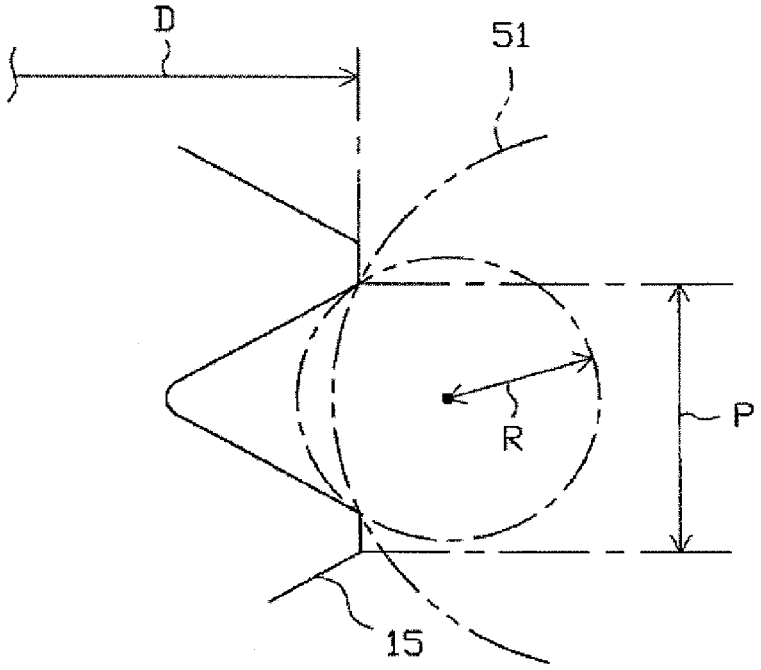
FIG. 5 is a conceptual diagram for describing a relation between a male screw portion and radius of curvature of an inner tube portion.

Furthermore, in this embodiment, the inner tube portion 51 does not assume a linear shape in the cross-section, but rather assumes a circular arc shape in the cross-section bulging towards the inner circumference side. However, when the radius of curvature of the circular arc is too small, there is a concern that the inner tube portion 51 enters into the area (valley) defined between the thread ridges. As shown in FIG. 5, in this embodiment, a radius of curvature R of the circular arc bulging towards the inner circumference side is set to be 0.44 P or more (P is defined as a pitch between the threads of the male screw portion 15) in order to eliminate this concern. A thread diameter of the male screw portion 15 of the spark plug 1 is typically selected from either M14 (outer diameter D of the thread ridge=13.725 mm), M12 (outer diameter D of the thread ridge=11.725 mm) or M10 (outer diameter D of the thread ridge=9.794 mm). When these thread diameters are adopted and the radius of curvature R is 0.44 P or more, the inner tube portion 51 does not practically enter into the space between the thread ridges.

As mentioned above, the gasket 18 in this embodiment has a configuration in which the minimum inner diameter of the inner tube portion 51 is larger than the outer diameter of the thread neck 17 and is smaller than the outer diameter of the thread ridge of the male screw portion 15. However, to enable the gasket to be positioned around the thread neck 17, the gasket must pass over male screw portion 15. Thus, the initial minimum inner diameter of the inner tube portion 51A must be larger than the outer diameter of the thread ridge of the male screw portion 15 to allow the gasket to pass over male screw portion 15.

Figure 6:
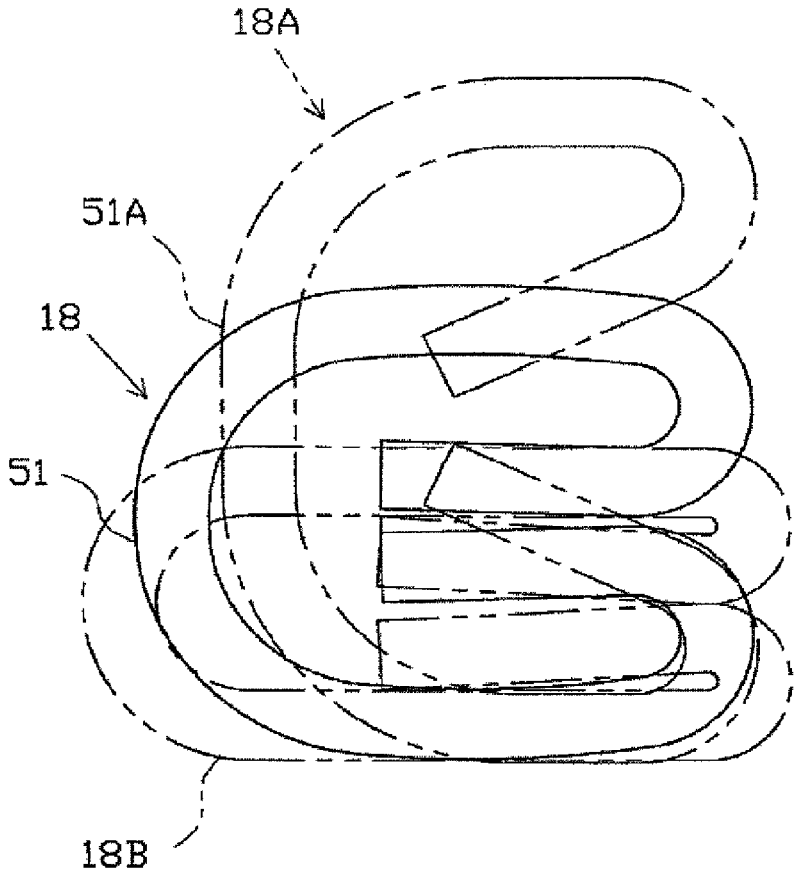
FIG. 6 is a conceptual diagram showing a gasket before processing, a gasket and a gasket after being mounted, all of which are overlapped.

Referring now to FIG. 6, the gasket prior to being positioned around thread neck 18 shall be described. Hereinafter, the gasket before it is attached to thread neck 17 shall be referred to as the "gasket before processing 18A." In FIG. 6, gasket before processing 18A is shown with a continuous line and in FIG. 7A, gasket before processing 18A is shown with a two-dot chain line. The gasket before processing 18A includes an inner tube portion 51A formed in an approximately linear shape and having a predetermined height. Similar to the gasket 18 after being mounted, the gasket before processing 18A is also comprised of an upper large diameter portion 52A, a lower large diameter portion 53A, an upper plate-like portion 54A, a lower plate-like portion 55A, an upper bending portion 56A, a lower bending portion 57A, an upper intervening plate-like portion 58A and a lower intervening plate-like portion 59A.

Thus, in order to obtain the gasket before processing IA which has the generally linear inner tube portion 51A, for example, a processing device 61 (shown in FIG. 7B) is used. That is, the processing device 61 includes an upper press die 62, a lower press die 63 and a support rod 64. Each of these has rigidity greater than the material constituting the gasket 18 and is made of a metal material being unlikely to deform. The upper press die 62 and the lower press die 63 include an annular concave portion 65, 66, respectively, and insertion holes 67, 68 through which the cylindrical support rod 64 is accommodated. A "gasket precursor before processing" generally having each portion 51A-59A of the gasket before processing 18A is prepared beforehand by a bending process or the like. Thereafter, the "gasket precursor before processing" is fitted around the support rod 64 and subjected to a press process by clamping it between the upper press die 62 and the lower press die 63. Then, the gasket precursor before processing is disposed in the concave portion 65 and 66 and is pressed from the top and bottom direction. At this time, a portion serving as the inner tube portion 51A receives a stress towards the inner circumference side. However, since the inner tube portion is in contact with an outer circumference face of the support rod 64, further deformations towards the inner circumference side is controlled. For this reason, the inner tube portion 51A of the gasket before processing 18A, which is obtained after the press process, assumes a linear shape extending in the axial center C2 direction. The inner diameter of the inner tube portion 51A of the gasket before processing 18A is larger than the outer diameter of the thread ridge of the male screw portion 15. In addition, the processing device 61 shown in FIG. 7B is a part of the manufacturing devices of the gasket 18. In reality, the gasket 18 is manufactured using a multistage press machine which is formed by a plurality of processing devices that is similar to the processing device 61 is assembled in a multistage structure.

The gasket before processing 18A slides over the male screw portion 15 and is positioned around the thread neck 17. In this position, it is subjected to a press process. A flat face of a press jig (not illustrated) presses the gasket before processing 18A towards the gasket receiving portion 16*a* from the front end side of the spark plug 1 to thereby form the gasket 18. That is, the spark plug 1 serving as an "automotive component" is produced. As is apparent from the above-described manufacturing process, the gasket 18 provided on the spark plug 1 assumes an identical cross-sectional shape along the entire circumference thereof (i.e., there is no plurality of nail portions as mentioned in the description of the prior art).

As is described in detail heretofore, the gasket 18 of this embodiment includes the inner tube portion 51 extending in the axial center C2 direction and constituting the inner circumference face of the gasket 18. Thus, unlike the conventional gasket where a nail portion thereof extending and pointing in an inward direction tends to enter into between the thread ridges of the male screw portion, it is possible to prevent the male screw portion 15 from biting into the inner tube portion 51 because the inner tube portion 51 has a predetermined height. As a result, when the gasket 18 is provided around the thread neck 17, it is possible to prevent the gasket 18 from falling out from the thread neck 17, as well as effectively preventing the male screw portion 15 from biting into the gasket.

In this embodiment, in the cross-sectional view passing through the axial center C2, the two tangent lines L1 and L2 contacting the upper large diameter portion 52 and the lower large diameter portion 53, respectively, are drawn so that the intersection angle defined by the tangent lines L1,L2 is 60 degrees. The axial center C2 of the gasket 18 and the tangent lines L1, L2, and the axis line C1 of the spark plug 1 and the outer line of the male screw portion 15 are projected on the same virtual plane to thereby align the axial center C2 and the axis line C1. On the projection view, the intersection CP of the tangent lines L1, L2 is located on the inner circumference side with respect to the thread core BT of the male screw portion 15. Further, the inner tube portion 51 does not assume the linear shape, but assume the circular arc shape in the cross-section bulging towards the inner circumference side. Since the radius of curvature R of the circular arc is set to be 0.44 P or more, the inner tube portion 51 does not effectively enter into between the thread ridges. As a result, it is possible to securely prevent a failure due to the male screw portion 15 biting into the gasket 18.

Moreover, in order to obtain the gasket 18 having the above described inner tube portion 51, a "gasket before processing 18A" having the generally linear inner tube portion 51A is prepared in advance. Thus, when performing the press process, after the "gasket before processing 18A" has slid over the male screw portion 15, the inner tube portion 51 is unlikely to point towards the inner side. In other words, although the inner tube portion 51 of the resulting gasket 18 assumes the circular arc shape in the cross-section and bulges towards the inner circumference side after the press process, the radius of curvature R of the circular arc is made large by forming the inner tube portion 51A of the gasket-before-processing 18A into the generally linear shape.

The present invention is not limited to the above-described embodiment, but may be modified as follows.

Figure 8A:
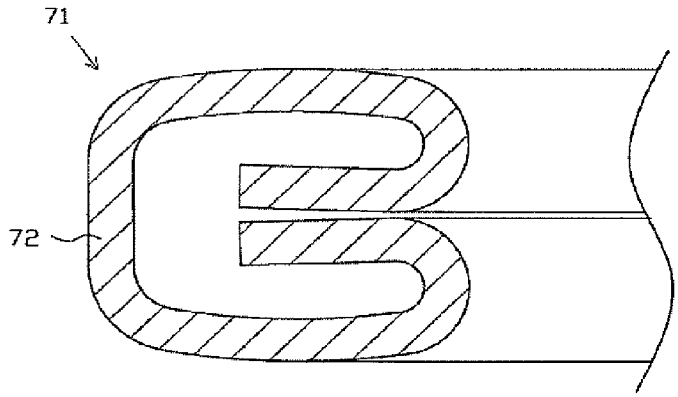
FIG. 8A is a cross-sectional view showing a gasket according to another embodiment.

(a) In the above-mentioned embodiment, the inner tube portion 51 of the gasket 18 assumes the circular arc shape in the cross-section and bulges towards the inner circumference side. However, as shown in FIG. 8A, an inner tube portion 72 of a gasket 71 may assume a linear shape in the cross-section parallel to the axial direction.

Figure 8B:
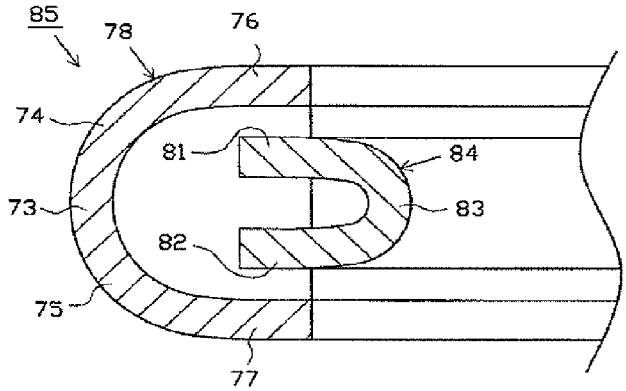
FIG. 8B is a cross-sectional view showing a gasket according to another embodiment.

(b) The gasket 18 is comprised of the inner tube portion 51, the upper large diameter portion 52, the lower large diameter portion 53, the upper plate-like portion 54, the lower plate-like portion 55, the upper bending portion 56, the lower bending portion 57, the upper intervening plate-like portion 58 and the lower intervening plate-like portion 59. These plate-like portions 51-59 are integrally formed in the continuous manner. However, they are not necessarily formed in this way. As shown in FIG. 8B, for example, a gasket 85 may be comprised of: an inner ring portion 78 comprised of an inner tube portion 73, an upper large diameter portion 74, a lower large diameter portion 75, an upper plate-like portion 76 and a lower plate-like portion 77; and an outer ring portion 84 comprised of an upper intervening plate-like portion 81, a lower intervening plate-like portion 82 and a bend portion 83 connecting the upper intervening plate-like portion 81 and the lower intervening plate-like portion 82. In addition, in the above-mentioned configuration, the entire circumference of inner ring portion 78 is formed in a continuous manner (joined without break) in order to secure a predetermined air tightness. On the other hand, the outer ring portion 84 may have a cut line therein (a beginning end and a terminal end).

Figure 8C:
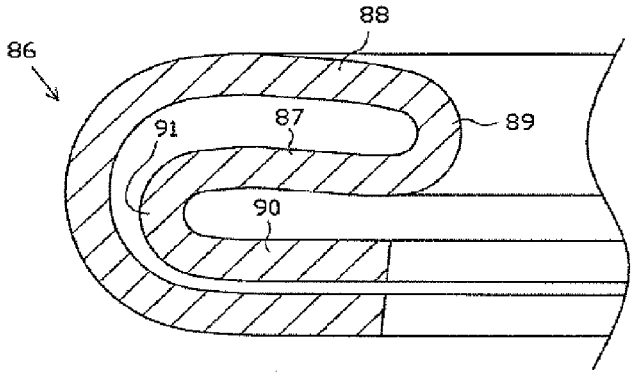
FIG. 8C is a cross-sectional view showing a gasket according to another embodiment.

(c) In the above-mentioned embodiment, the upper intervening plate-like portion 58 of the gasket 18 is integrally formed with the upper plate-like portion 54 in the continuous manner through the upper bending portion 56. The lower intervening plate-like portion 59 is integrally formed with the lower plate-like portion 55 in the continuous manner through the lower bending portion 57. On the other hand, as shown in FIG. 8C, for example, an upper intervening plate-like portion 87 of a gasket 86 may be integrally formed with an upper plate-like portion 88 in the continuous manner through an upper bending portion 89. Further, a lower intervening plate-like portion 90 may be integrally formed with the upper intervening plate-like portion 87 in the continuous manner through a bend portion 91. Reversely, the lower intervening plate-like portion is integrally formed with the lower plate-like portion in the continuous manner through the lower bending portion. Further, the upper intervening plate-like portion may be integrally formed with the lower intervening plate-like portion in the continuous manner through the bend portion (not illustrated).

(d) Although the upper large diameter portion 52 and the lower large diameter portion 53 assumes the circular arc shape in the cross-section in the above-mentioned embodiment, they may assume a generally linear shape in the cross-section as long as they extends from the upper and lower ends of the inner tube portion 51 in the axial direction so that the inner diameter of the gasket gradually increases.

(e) In the above-mentioned embodiment, in the cross-sectional view passing through the axial center C2, two tangent lines L1 and L2 contacting the upper large diameter portion 52 and the lower large diameter portion 53, respectively, are drawn so that the intersection angle defined by the tangent lines L1,L2 is 60 degrees. While the axial center C2 is aligned with the axis line C1, the tangent lines L1, L2 are projected on the male screw portion 15 (thread ridge, thread core). On the projection view, the intersection CP of the tangent lines L1, L2 is located on the inner circumference side (left-hand side in FIG. 4) with respect to the thread core BT of the male screw portion 15. Alternatively, the above-mentioned conditions may be fulfilled in such a manner that the tangent lines L1,L2 contacting an upper portion and a lower portion of the inner tube portion, respectively, (instead of the upper large diameter portion and the lower large diameter portion) are drawn depending on the shape of a gasket.

(f) in the above-mentioned embodiment, the upper intervening plate-like portion 58 and the lower intervening plate-like portion 59 serving as the intervening plate-like portion are provided. However, either the upper intervening plate-like portion or the lower intervening plate-like portion may be provided.

Figure 7A:
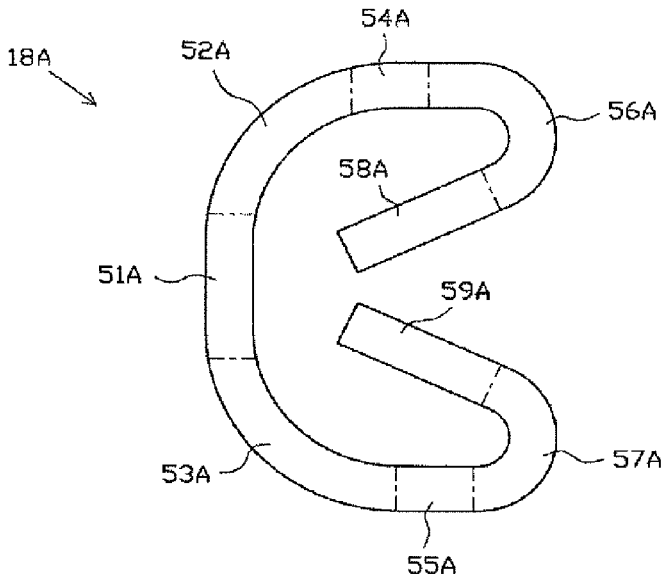
FIG. 7A is an explanatory view showing a formation method of a gasket before processing.
Figure 7B:
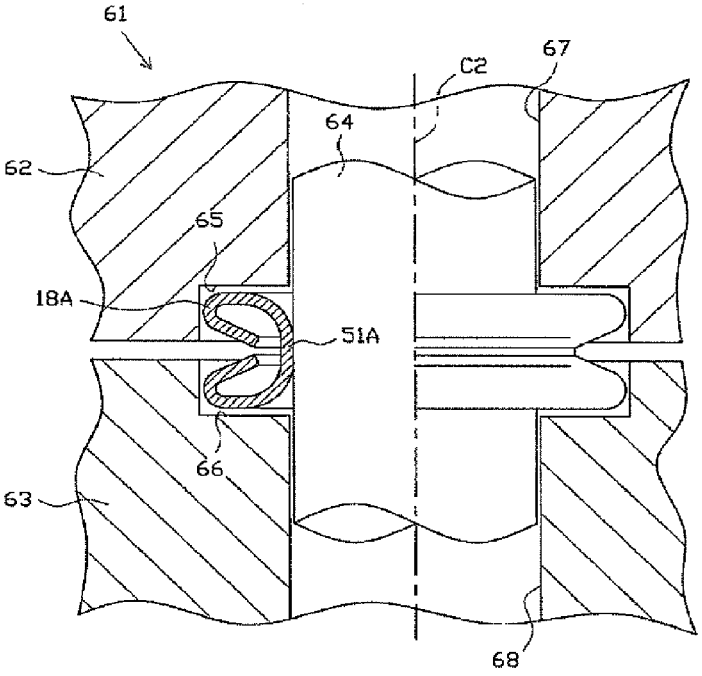
FIG. 7B is a cross-sectional view showing a processing device etc.
Figure 9A:
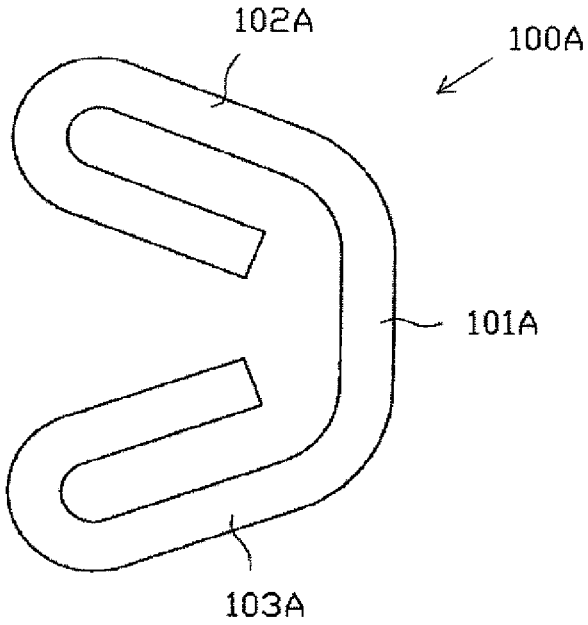
FIG. 9A is a schematic view showing a cross-sectional end face of a gasket before processing according to another embodiment.
Figure 9B:
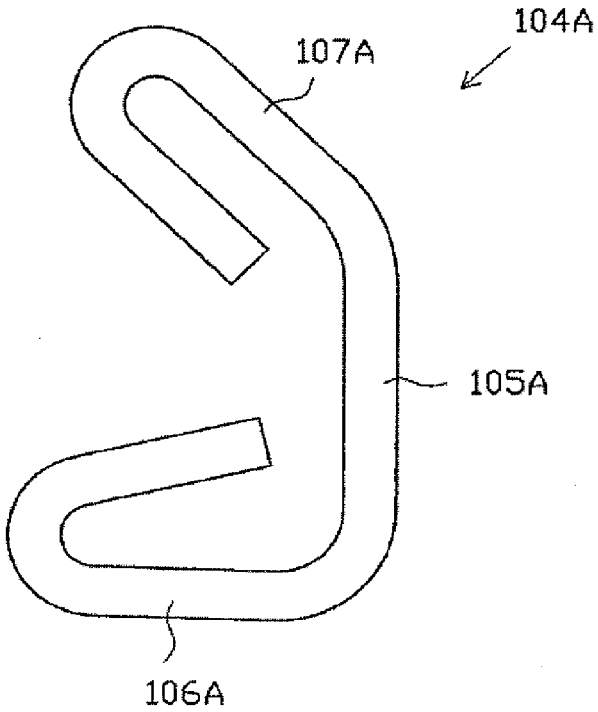
FIG. 9B is a schematic view showing a cross-sectional end face of a gasket before processing according to another embodiment.

(g) In the above-mentioned embodiment, although the typical shape of the gasket-before-processing 18A (the inner tube portion 51A extends perpendicular to the upper plate-like portion 54A and the lower plate-like portion 55A) is shown in FIG. 7A (with a solid line) and in FIG. 6 (with a two-dot chain line), it may assume another shape. As shown in FIG. 9A, for example, an angle defined by an inner tube portion 101A and an upper plate-like portion 102A of a gasket before processing 100A, and an angle defined by the inner tube portion 101A and a lower plate-like portion 103A may be obtuse angles. Further, as shown in FIG. 9B, an angle defined by an inner tube portion 105A and a lower plate-like portion 106A of a gasket before processing 104A may be a generally right angle, and an angle defined by the inner tube portion 105A and an upper plate-like portion 107A may be an obtuse angle.

(h) Although a material of the gasket 18 is not limited, copper, zinc, aluminum, iron or an alloy containing one of the above materials (e.g., stainless steel or the like) may be employed.

(i) Although the above embodiment embodies the gasket 18 provided in the spark plug 1, it is also possible to apply this technical concept to a gasket provided in other automotive components, such as sensors.

The invention claimed is:

1. An annular gasket for an automotive component, said automotive component having a front end extending to a rear end in an axial direction; a male screw portion with a thread ridge; a thread neck having a smaller outer diameter than that of the thread ridge of the male screw portion, and a gasket receiving portion with a flat face facing the front end and located at a rear end side of the thread neck, wherein the thread neck is formed between the male screw portion and the gasket receiving portion, and has an axial center which serves as a center of the annular gasket and, said annular gasket comprising:

a plurality of essentially flat, plate-like portions stacked in the axial direction, a continuous inner section comprised of an inner tube portion, an upper large diameter portion and a lower large diameter portion, said inner tube portion extending in the axial direction and defining an inner circumference face of the gasket, the inner tube portion having a minimum inner diameter that is larger than an outer diameter of the thread ridge of the male screw portion when the annular gasket is in an uncompressed state and a second minimum diameter larger than the outer diameter of the thread neck and smaller than the thread ridge of the male screw portion when the annular gasket is in a compressed state and the inner tube portion has a linear shape in the cross-section parallel to the axial direction when the annular gasket is in the uncompressed state and a circular arc shape in the cross-section with a radius of curvature R of 0.44 P or more bulging towards an inner circumference side when the annular gasket is in the compressed state wherein P is a thread pitch of the male screw portion; and said upper large diameter portion and said lower large diameter portion extending respectively in the axial direction from an upper end and a lower end of the inner tube portion so that an inner diameter of the gasket gradually increases;

an essentially flat, upper plate-like portion and an essentially flat, lower plate-like portion extending in a radial direction perpendicular to the axial direction from the upper large diameter portion and the lower large diameter portion of said continuous inner section, respectively; and an upper intervening plate-like portion and a lower intervening plate-like portion intervening between the upper plate-like portion and the lower plate-like portion, wherein the upper intervening plate-like portion is integrally formed with the upper plate-like portion in a continuous manner through an upper bending portion and the lower intervening plate-like portion is integrally formed with the lower plate-like portion in a continuous manner through a lower bending portion, wherein the upper intervening plate-like portion and the lower intervening plate-like portion are angled toward each other when the annular gasket is in the uncompressed state and wherein the gasket assumes an identical cross-sectional shape along an entire circumference thereof.

2. A gasket according to claim 1, wherein, in the cross-sectional view passing through the axial center of the gasket, two tangent lines contacting the upper large diameter portion and the lower large diameter portion, respectively, are drawn so that an intersection angle defined by the tangent lines is 60 degrees, wherein the axial center of the gasket and the tangent lines, and the axis line of an automotive component and an outer line of the male screw portion are projected on the same virtual plane to thereby align the axial center and the axis line, wherein the intersection of the tangent lines is located on an inner circumference side with respect to a thread core of the male screw portion.

3. A gasket according to claim 1 or 2, wherein all the plate-like portions are integrally formed in a continuous manner.

4. In combination, an automotive component and an annular gasket, said automotive component comprising:

a front end extending to a rear end in an axial direction;

a male screw portion with a thread ridge;

a thread neck having a smaller outer diameter than that of the thread ridge of the male screw portion; and a gasket receiving portion with a flat face facing the front end and located at a rear end side of the thread neck, wherein the thread neck is formed between the male screw portion and the gasket receiving portion, and has an axial center which serves as a center of the annular gasket, and said annular gasket comprising:

a plurality of essentially flat, plate-like portions stacked in the axial direction;

a continuous inner section comprised of an inner tube portion, an upper large diameter portion and a lower large diameter portion, said inner tube portion extending in the axial direction and defining an inner circumference face of the gasket, the inner tube portion having a minimum inner diameter that is larger than an outer diameter of the thread ridge of the male screw portion when the annular gasket is in an uncompressed state and a second minimum diameter larger than the outer diameter of the thread neck and smaller than the thread ridge of the male screw portion when the annular gasket is in a compressed state and the inner tube portion has a linear shape in the cross-section parallel to the axial direction when the annular gasket is in the uncompressed state and a circular arc shape in the cross-section with a radius of curvature R of 0.44 P or more bulging towards an inner circumference side when the annular gasket is in the compressed state wherein P is a thread pitch of the male screw portion, and said upper large diameter portion and said lower large diameter portion extending respectively in the axial direction from an upper end and a lower end of the inner tube portion so that an inner diameter of the gasket gradually increases;

an essentially flat, upper plate-like portion and an essentially flat, lower plate-like portion extending in a radial direction perpendicular to the axial direction from the upper large diameter portion and the lower large diameter portion of said continuous inner section, respectively; and an upper intervening plate-like portion and a lower intervening plate-like portion intervening between the upper plate-like portion and the lower plate-like portion, wherein the upper intervening plate-like portion is integrally formed with the upper plate-like portion in a continuous manner through an upper bending portion and the lower intervening plate-like portion is integrally formed with the lower plate-like portion in a continuous manner through a lower bending portion, wherein the upper intervening plate-like portion and the lower intervening plate-like portion are angled toward each other when the annular gasket is in the uncompressed state and wherein the gasket assumes an identical cross-sectional shape along an entire circumference thereof.

* * * * *